United States Patent [19]

Wakeman

[11] Patent Number: 4,615,306

[45] Date of Patent: Oct. 7, 1986

[54] ENGINE VALVE TIMING CONTROL SYSTEM

[75] Inventor: Russell J. Wakeman, Newport News, Va.

[73] Assignee: Allied Corporation, Morris Township, Morris County, N.J.

[21] Appl. No.: 810,535

[22] Filed: Dec. 17, 1985

Related U.S. Application Data

[63] Continuation of Ser. No. 575,355, Jan. 30, 1984, abandoned.

[51] Int. Cl.[4] ..... F01L 1/34

[52] U.S. Cl. ..... 123/90.16; 123/90.46

[58] Field of Search ..... 123/90.16, 90.46, 90.12, 123/90.13; 91/459

[56] References Cited

U.S. PATENT DOCUMENTS

| | | | |
|---|---|---|---|
| 2,107,393 | 10/1938 | Seilley | 123/90.16 |
| 3,385,274 | 5/1969 | Shunta et al. | 123/90 |
| 3,439,661 | 4/1969 | Weiler | 123/90 |
| 3,786,792 | 1/1974 | Pelizzoni et al. | 123/90.16 |
| 4,000,756 | 1/1977 | Ule | 123/90.16 |
| 4,009,695 | 3/1977 | Ule | 123/90.16 |
| 4,077,369 | 3/1978 | Buehner | 123/90.16 |
| 4,111,165 | 9/1978 | Aoyama et al. | 123/90.15 |
| 4,112,884 | 9/1978 | Tominaga | 123/90.48 |
| 4,167,931 | 9/1979 | Sizuka | 123/90.46 X |
| 4,258,671 | 3/1981 | Takizawa et al. | 123/90.16 |
| 4,452,187 | 6/1984 | Kosuda et al. | 123/90.16 |

*Primary Examiner*—William R. Cline
*Assistant Examiner*—Peggy A. Neils
*Attorney, Agent, or Firm*—Russel C. Wells; Markell Seitzman

[57] ABSTRACT

An engine valve timing control system using electrohydraulic valve lifters or adjusters operatively connected to a microprocessor based electronic control unit will provide real time charges in engine valve timing. As a result, engine performance will be improved over the mechanically controlled engine valves which at best are compromises between engine operating extremes. Each lifter is "homed" to the base circle of the cam through the use of check valves and high pressure pulses generated in the oil lines supplying the lifters.

2 Claims, 7 Drawing Figures

30
PROM
40
PTM
T1 T2 T3
24
26
27
28
MPU
CRANK
WOT
CTS
40
PTM
T4 T5 T6
42
126
38
IOT
TDC
ϕ LOCK LOOP
36
44
46
48
50
SOLENOID
SOLENOID
SOLENOID
SOLENOID
IT
35
124
51
57
52
58
53
55
54
56
PUMP
64
34
12
10
22
14
OXYGEN
COOLANT TEMP.
16
AIR TEMP.
18
TPS
20
MAP
SENSORS
A/D

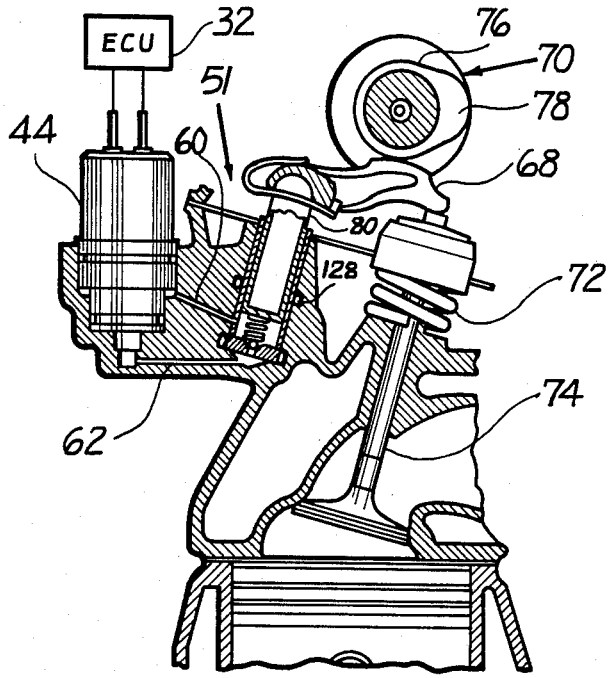
Fig. 5
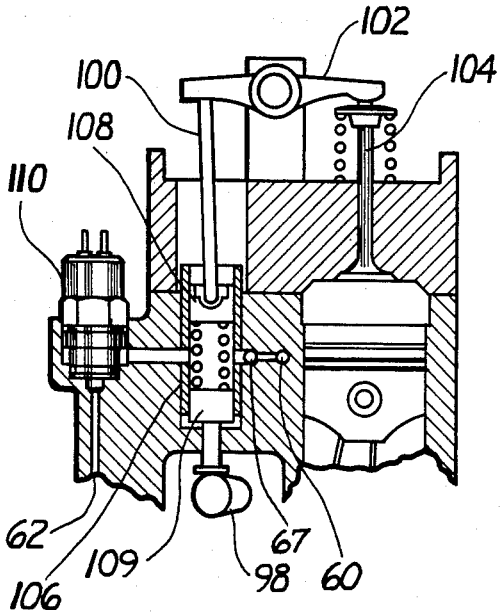
Fig. 6
Fig. 7
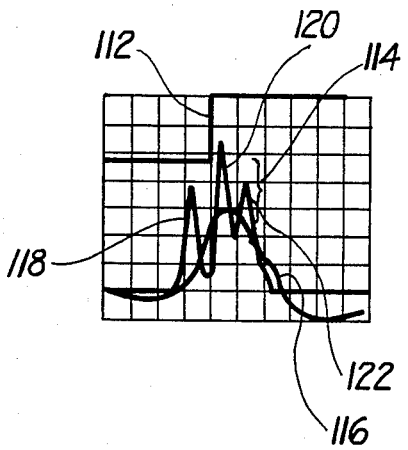

ENGINE VALVE TIMING CONTROL SYSTEM

This application is a continuation of application Ser. No. 575,355 filed 1-30-84 now abandoned.

This invention relates to engine control systems in general and more particularly to electrohydraulic control systems for controlling the timing of the intake and exhaust valves in internal combustion engines.

BACKGROUND OF THE INVENTION

Prior Art

It has been long recognized by engine builders and more particularly by specialists in high performance engines that control of valve timing will yield desired engine operation results. The ideal timing of intake and exhaust valves at idle conditions, at normal load range conditions and at high performance conditions is very different. Since valves are controlled by cams it is necessary to compromise the timing to suit a particular purpose. In production engines, valve timing is a compromise leaning towards the normal load or speed ranges to the detriment of the idle range and the high performance range. Likewise in high performance engines the timing is adjusted toward the high performance demands of the engine and therefore at the idle and normal load ranges valve timing is not optimal.

As early as 1903 Alexander Winton used a pneumatic device to vary valve lift. His particular intent at that time was throttling the engine with intake valves as opposed to throttling the engine with the conventional throttle plate. More recently there have been centrifugal cam sprockets which are capable of varying valve timing as a function of engine speed but not varying lift or duration of opening.

In addition there have been systems which completely disable the operation of the valves and therefore effectively close off one or more cylinders during different engine operating ranges. A recent commercial engine using this concept is Cadillac's 8-6-4 engine. In most of the known control systems the forces involved in opening and closing valves in the engine requires expensive and very high powered solenoids. This places a high cost penalty on the engine for the consumer.

U.S. Pat. No. 3,439,661 entitled "Control Displacement Hydraulic Lifter" by Weiler, teaches a hydraulic valve lifter. U.S. Pat. No. 4,112,884 entitled "Valve Lifter for an Internal Combustion Engine" by Tominaga, teaches a valve lifter design. Both patents operate to provide some timing control to the valves. U.S. Pat. No. 4,111,165 entitled "Valve Operating Mechanism of an Internal Combustion Engine" by Aoyama et al, teaches control of the oil in a hydraulic valve lifter in response to engine speed and throttle opening to spill the oil during deceleration thereby limiting the traveling of the valve lifter. U.S. Pat. No. 4,258,671 entitled "Variable Lift Mechanism used in Internal Combustion Engine" by Takizawa et al, teaches electromagnetic valve control of hydraulic valve lifters in an overhead cam (OHC) engine. In response to engine temperatures, manifold pressure and speed, the oil pressure in the lifter is adjusted to form the solid link necessary to operate the engine valve. This particular patent ('671) teaches the control of all cylinders. Each of the last two patents ('165 and '671) does not teach driving the oil back into the lifter for restoring the valve lifter to a normal start position after each operation in order that each engine cycle is independently controlled. Therefore, in the next engine cycle the electronic control unit controlling the operation of the oil does not know the location of the lifter. If the next engine cycle requires a later valve opening, the valve opening will not change from the previous engine cycle inasmuch as the lifter has not been re-extended. Aoyama et al shows a pump and a regulator to supply oil pressure to the lifter and Takizawa et al teaches an oil supply gallery fed by an oil supply which is driven by the engine. Without more, the normal engine oil pressures are inadequate to return a collapsed lifter to its full height in the available time between engine cycles. In both systems, the addition of a boost pressure pump of adequate pressure capacity is both expensive and adds an unnecessary load on the engine, therefore defeating the purposes and the advantages gained by controlling the valves of an engine.

To solve the above problems, there is disclosed herein an engine valve timing control system using the engine oil supply to operate the hydraulic valve lifters or adjusters. By controlling the fluid pressures pulses developed within the oil supply as a result of lifter operation, very high pulsed pressures are directed to the various lifters to assist in returning or re-extending the lifters to their normal position between engine cycles. The system is a microprocessor based control system wherein various engine sensors sense the engine conditions and the microprocessor in response to the sensed engine conditions addresses a memory unit containing a map of engine conditions versus valve opening times. From the memory unit a signal is supplied to a particular timer unit for a given cylinder. The timer, operating in conjunction with a known position of the piston in the cylinder will operate electrohydraulic solenoid valves for directing and maintaining a predetermined amount of oil in an associated hydraulic lifter.

These and other advantages will be found in the following detailed description and drawings.

BRIEF DESCRIPTION OF THE DRAWINGS

In the drawings:

FIG. 5 is a sectional view of an overhead cam valve system;

FIG. 6 is a sectional view of a push rod valve system; and

FIG. 7 is a timing diagram.

DETAILED DESCRIPTION

Referring to the FIGURES by the numerals and characters of reference there is disclosed an engine valve timing control system. The system utilizes a microprocessor based control system to control the opening time and duration of intake and exhaust valves in one or more cylinders of an internal combustion engine.

Figure 1:
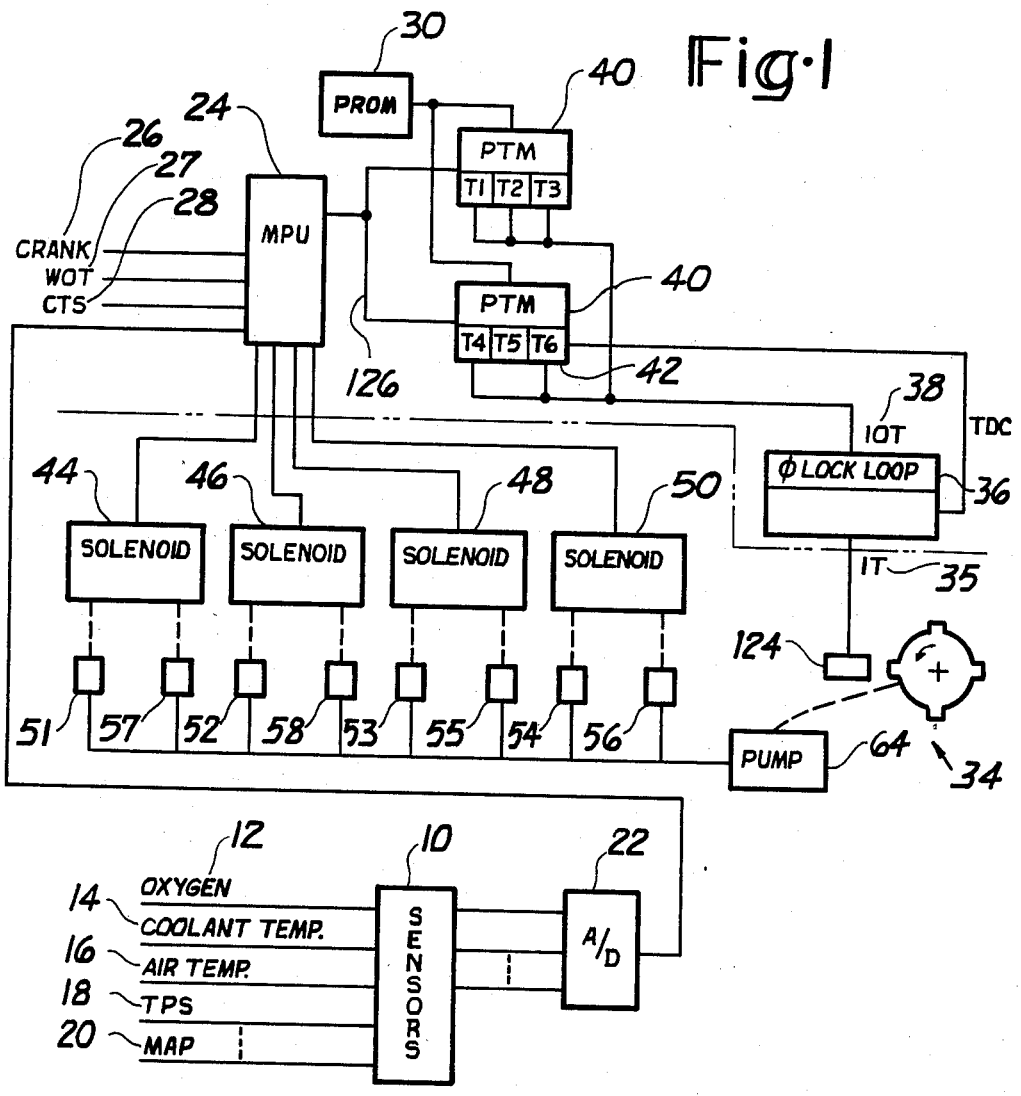
FIG. 1 is a schematic view of the control system of the invention.

FIG. 1 is a schematic of the control system showing the various elements of the system. The various engine operating conditions are sensed by one or more sensors 10 such as an exhaust gas sensor which is typically an oxygen gas sensor 12 indicating the quality of combustion of the engine. Temperature sensors indicating the temperature of the engine 14 and the temperature of the air 16 supply signals into the system. Another sensor indicates the position 18 of the throttle and to determine the amount of fuel required by the engine manifold absolute pressure 20 sensor may be employed. However if such system is a speed-density fuel injection system, it must calculate air flow by several sensed variables and an empirically determined volumetric efficiency of the engine. For the present valve timing system it is advantageous to measure the air intake into the system and therefore a mass airflow meter may be located in the air intake of the engine. By measuring air flow directly, it is not necessary to store an empirically determined volumetric efficiency map to determine air flow. By changing valve timing, volumetric efficiency is intentionally changed complicating any air flow calculations, therefore direct measurement of air flow is preferred.

Those sensors which develop an analog signal are processed through an analog-to-digital converter 22 converting the sensor signals to digital equivalents used by the microprocessor 24. Additional inputs to the microprocessor indicate engine starting 26 and the extreme positions 27, 28 of the throttle blade in the throttle body. The microprocessor 24 receives the several signals indicating the engine conditions and according to control laws stored in its memory, various engine control signals are developed. The microprocessor 24 is a Motorola 68701.

The present system is concerned with the control of engine valves and has a memory system such as a programmable read only memory (PROM) 30 containing a memory map of the engine events for the particular engine with various valve opening positions. In order to adapt this system to a family of engines, each member of the engine family has its own particular PROM 30 which is plugged into the system. The microprocessor addresses the PROM 30 as a result of the engine conditions to determine a particular valve opening timing and duration for the various cylinders. The PROM 30 is a Motorola 2716.

The ECU 32 is synchronized with the engine by means of a timing means 34 coupled to the engine camshaft. The timing means 34 generates a signal indicating the known position of the piston in each cylinder such as top dead center (TDC) of the compression stroke or bottom dead center (BDC) of the power stroke. The camshaft is coupled to the engine crankshaft and rotates at half the speed of the crankshaft or once per engine cycle. The engine crankshaft supplies power to drive the oil pressure pump 64 pumping engine oil through the engine. This oil is used in the valve lifters or adjusters of the present system.

Signals 35 from the timing means 34 are supplied to a timing phase lock loop timing circuit 36 wherein the frequency of each input signal 35 is multiplied by a factor of ten for fine timing. The output signals 38 of the phase lock loop timing circuit 36, namely the fine timing signal 38, is supplied to several programmable timing units 40, one timing unit for each cylinder. The fine timing signal 38 operates to bring the timing units 40 to a predetermined timing position for initiating valve operation of each cylinder. There is an additional timing unit 42 which responds to the known position of the piston in a given cylinder, more particular to the position of the piston in the number one cylinder. From this timing unit 42 the relative positions of the pistons in the remaining cylinders are determined. The programming timing units 40 are Motorola 6840 units.

The predetermined signals from each of the timing units 40 are supplied to the microprocessor 24 for generating control signals to solenoid control valves 44–50. The valves 44–50, in response to the signals control the flow of oil out of a hydraulic valve lifter 51–58 for controlling the time of the engine valve in a manner as will hereinafter be explained.

Figure 2:
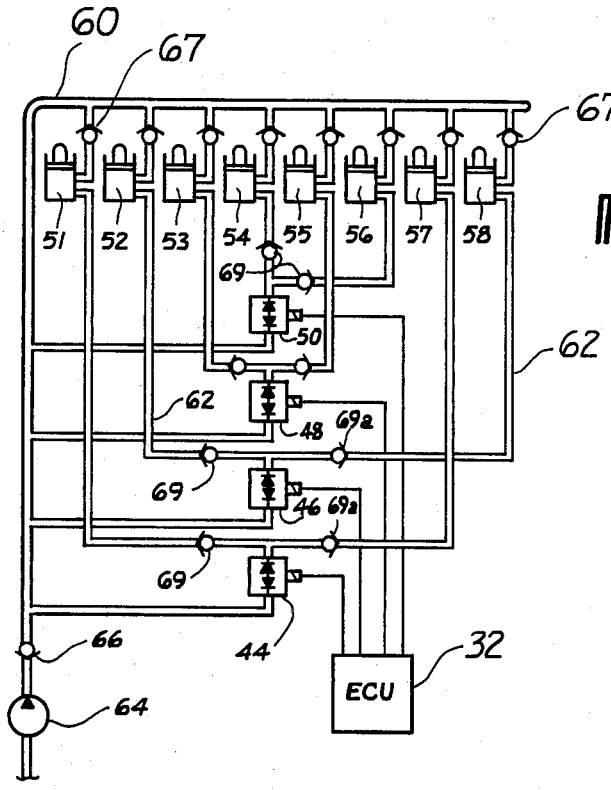
FIG. 2 is a schematic of the hydraulic system of the invention.

Referring to FIG. 2 there is illustrated a schematic of the hydraulic circuit for the engine valve timing control system. For the purpose of illustration this system will be described in a four cylinder internal combustion spark ignited engine. The particular firing order of the ignition system for the engine is one-two-four-three.

FIG. 2 illustrates the grouping of the engine valves which are 180 camshaft degrees apart. In particular, the intake valve for cylinder one and the intake valve for cylinder four are grouped together and controlled by a first solenoid valve 44. Likewise exhaust valve one and exhaust valve four controlled by a second solenoid valve 46; intake valve two and intake valve three controlled by a third solenoid valve 48; and exhaust valve two and exhaust three controlled by a fourth solenoid valve 50; are grouped. Thus in FIG. 2 the four solenoid valves 44–50 control the four cylinders. The oil supply galleries 60, which are found in the engine block, provide supply 60 and return lines 62 for the engine oil between the various valve lifters 51–58. The engine oil pump 64 supplies engine oil under pressure to the system, which is a closed loop system, through a check valve 66 preventing the oil in the system from returning back to the engine oil pump 64. The check valve 66 allows only oil to be supplied to the system to replace any oil lost due to leakage such as around the valve lifter sliding seals. Additional check valves 67. 69 are located in both the supply 60 and the return 62 lines for each valve lifter 51–58. The ECU 32, which is more fully illustrated in FIG. 1, is shown in schematic form, controls each solenoid valve 44–50. In the particular system to be described, the solenoid valves 44–50 are actuated to close the return lines 62 maintaining the oil in the various lifters causing the engine valves to be opened.

Referring to FIG. 5 there is illustrated the control for one engine valve in an overhead cam system showing the bleed solenoid control valve 44, the engine valve lifter 51, the cam follower 68, the overhead cam 70, the engine valve spring 72 and the engine valve 74. Additionally the various oil supply galleries 60 and the lifter oil bleed passages 62 for supplying oil to and from the lifter are shown.

The overhead cam 70 has a base diameter 76 and extending therefrom at a particular annular position is a lobe 78. As the cam follower 68 rides along the cam surface the rise and fall surfaces of the lobe cause the engine 72 valve to open and close. This is conventional valve operation and will not be explained here.

The present invention in the overhead cam system utilizes the length of height of the valve lifter piston 80 for controlling the pivot point for the cam follower 68. As the piston 80 of the valve lifter 51 is extended further out of its housing 82, the cam follower 68 will respectively operate to open or close the valve earlier or later on the cam 70 profile. Earlier valve opening and therefore a larger valve opening for a longer duration may be used in a high speed engine operation or heavy load where more fuel is desired to be injected into the cylinder. If the lifter piston 80 is retracted into the housing 82 of the valve lifter 51 the profile of the cam will cause the cam follower 68 to be driven down onto the lifter. When the overall length of the lifter 51 is fixed at its length then the profile of the cam 70 will cause the follower 68 to be driven down on the engine valve 74 and against the valve spring 72 opening the valve 74.

At an idle condition a late engine valve opening is desired and the amount of opening of the valve is small, the closing of the valve is quicker than before. This causes less fuel to be injected into the engine therefore the emissions of the engine at idle speed are improved. Also at idle condition the short duration of the engine valve opening eliminates valve overlap thereby reducing the contamination of the fresh incoming fuel charge by the exhaust residue. Valve overlap is less of a problem to combustion quality at high speeds and loads where the time is shorter and the manifold pressure differential across the engine is reduced because of reduced contamination. However at high speeds and loads, overlap improves power and economy.

In order to have the lifter piston 80 move in and out of its housing the supply of the oil to the hydraulic lifter 51 is controlled. When the correct operate time is reached the solenoid control valve 44 is closed sealing off the return line 62 and keeping the oil in the hydraulic lifter 51. This forms a solid oil link causing the lifter piston 80 to remain stationary and the cam follower 68 then pivots on the lifter piston under the operating force of the cam 70 to actuate the valve 74.

Figure 3:
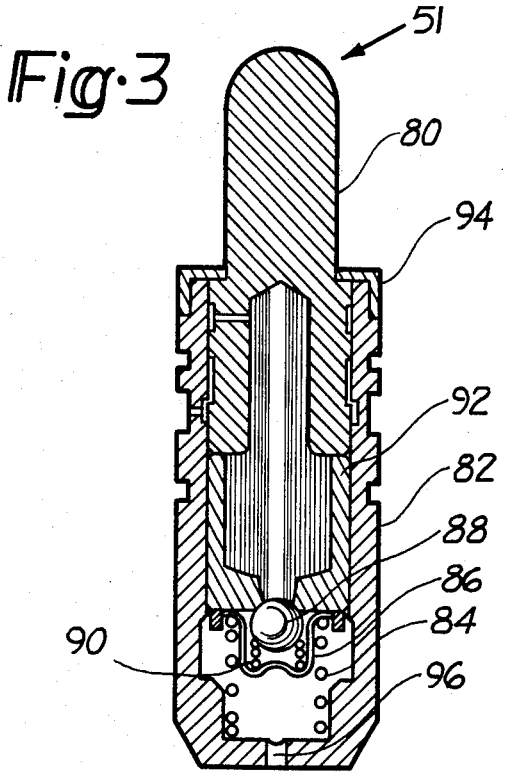
FIG. 3 is a sectional view of a valve lifter.
Figure 4:
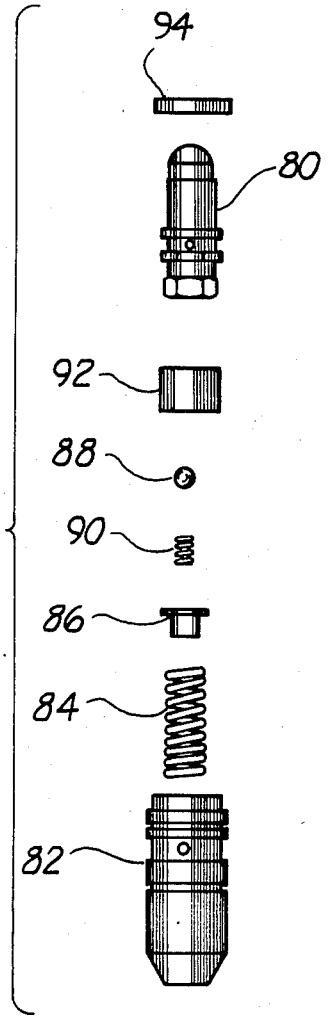
FIG. 4 is an exploded view of the valve lifter of FIG. 3.

An exploded view of a valve lifter 51 as shown in FIG. 4 is used in the present application. The valve lifter illustrated has a lifter body 82 in which is a return spring 84, check valve retainer 86, check ball valve 88 and spring 90, check valve piston 92, lifter piston 80 and a piston retainer 94. It is a function of the return spring 84 to return the lifter piston 80 to its extended position and as will herein be shown the force of the return spring 84 plus the pressure pulse as shown in FIG. 7, from the oil lines 60 cooperate to return the piston 80. The check ball 88, ball spring 90 and valve retainer 86 operate to maintain oil in the interior of the check valve piston 92 and permit the oil to flow out of the lifter to the return lines 62. As illustrated in FIG. 3, the oil supply line 62 comes into the valve lifter at the upper portion of the valve body 82 and flows out of an orifice 96 in the bottom of the valve body 82. Thus the flow of oil is through the check valve 88 into the cavity where the return spring 84 is located and out of the bottom of the lifter through the orifice 96.

FIG. 6 illustrates the adaptation of the present invention to a push rod construction. The cam 98 is below the piston and a push rod 100 is connected between the cam 98 and a rocker arm 102 to open or close the engine valve 104. Again the operation of the cam, push rod, rocker arm and valve assemblies are well known and will not be explained here. However between the cam 98 and the rocker arm 102 and in line with the push rod 100 is the solenoid controlled hydraulic valve lifter 106. The operation of this system is similar to that previously explained in that the hydraulic link is formed under the control of the solenoid 110 between both ends of the piston 108, 109 in the lifter 106. Thus when the control solenoid 110 is not energized the oil will flow from the oil supply gallery 60 through the check valve 67 and through the hydraulic lifter. If the lower push rod piston 109 is being moved up the cam 98 surface the oil is pushed out of the lifter into the bleed passageways 62. However once the solenoid is energized the bleed passageways are closed and the oil between the two pistons 108, 109 forms a solid link coupling the motion of the lower piston 109 to the push rod piston 108 causing the push rod 100 to operate on the rocker arm 102 in a conventional manner for opening the valve. Thus in this particular system as in the system of FIG. 5 the formation of the solid link controls the timing of the engine valve 104.

FIG. 7 is a graphic representation of the timing of the system. More particularly the upper trace 112 illustrates the closing of the solenoid control valve 110, the center trace 114 illustrates the pressure pulses in the galley lines 60, 62 and the lower trace 116 is a trace depicting the travel of the engine valve. Referring to the center trace, which shows the pressure pulses on the system, the first pulse 118 is the cam follower 68 contacting the cam 70 in such a manner as to push the lifter piston 80 down causing oil to be removed from the lifter 51. The second pulse 120 is the pulse generated by the closing of the solenoid and the forming of the solid oil link and the suddenly applied pressure of the cam through the cam follower onto the link. It is believed that the third pulse 122 is an echo in the oil lines as a result of reflections from the interior of the hydraulic passages.

Operation

Referring to FIGS. 1, 2 and 5 the various fill and return check valves 67, 69 and **69*a* prevent the flow of the oil except in those directions in which the designer wants the oil to flow. The present system is mainly concerned with controlling the opening time of the engine valve which thereby, because of the cam design, controls not only the length of time the valve is open but the amount of lift of the valve itself. As previously explained the ECU 32** determines, under actual engine operating conditions, the ideal time for the engine valve to open.

This is done by means of timing units 40, 42 wherein the first timing unit 42 is an absolute timing unit indicating the time from a predetermined engine event such as top dead center of the engine piston on the compression stroke in cylinder one. As illustrated in FIG. 1 the sensor 124 coupling the timing means 34 into the logic of the phase lock loop 36, will generate a particular signal indicating the engine piston position at top dead center of cylinder one and any other known position on the system. By suitable design of the timing means 34 it may well indicate the position of top dead center of each and every engine piston and by further design of the timing means the signal will be generated such that the position of top dead center of cylinder one is particularly identified.

Located in the map of the engine events located in the PROM 30 for a given engine condition the time of an intake engine valve opening for a particular cylinder is stored as the time from the top dead center of a known cylinder or event. This time value is located in the time units 40 and the phase lock loop fine timing signal 38 operates to count down the timing unit 40 of a particular cylinder to a predetermined number. An output signal 126 is generated indicating the time the valve should be actuated which in the present system is the time that the solenoid control valve 44–50 should be closed. The signals are processed through the microprocessor 32 to the particular solenoid control valve for actuation.

The above system describes how to control the opening time of either an intake valve or an exhaust valve for a given cylinder. In order to control the actual closing of the engine valve 74 which is on the fall side of the cam lobe 78, a heavy duty solenoid is required. The forces bearing against the lifters and the forces transmitted through the oil to bear against the plunger of the solenoid control valve 44 are very high making the plunger very difficult to move. However the closing time of the engine valve 74 is a direct function of the opening time and the closer that the opening time gets to the top of the lobe 78 of the cam 70 the closer the closing time is to the top of the lobe 78 of the cam on the reverse side of the cam.

As stated with reference to FIG. 7 the various pressure pulses 118, 120, 122 which are generated are supplied through the fluid system. These pulses operate to force additional oil into the various lifters 51–58 to return the lifter pistons 80 to their normal position. However for the lifter that is under control by the lobe 78 of the cam 70 the pressure pulse to the lifter piston 80 will not move the piston as the cam 70 begins to move the valve stem 74.

As the cam opening ramp begins to move the cam follower 68, the open solenoid valve 44 allows the lifter piston 80 to collapse. The flow of oil out of the lifter 51 closes the lifter fill check valve 88. This forces the oil flowing out of the lifter to open the return check valve 69 and flow through the open solenoid valve 44. The return check valve **69*a* on the lifter 57 paired on the same solenoid valve 44 is closed by this flow to prevent uncontrolled flow from going back into the other lifter 57 of the pair. Thus, the solenoid valve 44 has absolute control of the flow of oil out of the lifter 51. The flow of oil out of the solenoid valve 44 is then channeled into idle lifters to pump them back to the full extended position. The lifter 51 collapse continues until the ECU 32 determines that it is the correct time to start to open the engine valve 74. The ECU 32 then generates an electrical signal to close the solenoid valve 44, stopping the flow of oil out of the lifter 51, and creating a solid hydraulic link inside the lifter body. At this point the force to compress the hydraulic fluid in the lifter 51 is much greater than the force required to compress the valve spring 72. The motion of the cam then opens the engine valve 74** rather than collapsing the lifter.

The cam follower 68 and valve 74 track the remainder of the cam profile giving the valve the motion dictated by the cam 70 profile, but reduced by the amount of initial lifter collapse. As the cam 70 closes the engine valve 74, the follower 68 loses contact with the cam 70 as the engine 74 valve seats and the cam profile continues to ramp toward the base circle 76. At this point with the solenoid valve 44 still closed, pulses from other lifters 52–58 enter through the fill check valve 67 and with help from the lifter return spring 84, pump the lifter piston 80 up so that the cam follower 68 remains in contact with the cam base circle 76. At some point with the lifter fully extended again and the cam follower 68 again in contact with the cam base circle 76 the solenoid valve 44 can be opened again to complete the cycle and prepare for the next cycle. To open the solenoid valve before this time would allow the pressure pulses from other cylinders to flow in the fill check valve 67, through the lifter, and out through the open solenoid valve without doing any work to return the piston.

It is to be appreciated that the various valve springs 72 and the resulting cam forces applied to the valve 74, 104 by the cam follower 68, 102 are very high and therefore the cam follower will take the path of least resistance as it is being positioned for opening or closing of the valve. Such path of least resistance is the piston on the lifter operating against the oil pressure of the oil system and the cam follower will drive the oil out of the lifter until the solenoid valve is closed.

The performance benefits of the system are that the engine will develop more power for a given engine size and in the very large engines there will be better fuel efficiency and less dilution charge at idle from reduced valve overlap. In addition by controlling the intake and exhaust valves, hydrocarbons and emission qualities are better controlled. During deceleration operations the amount of fuel entering the cylinder is less and therefore deceleration emission and fuel economy performances are improved.

In the present system, it is a distinct advantage to use the pressure pulses 118–122 from collapsing lifters to return the piston of the inactive lifters to the cam base circle. By doing this the start position of each valve opening time is identified and is repeatable. Further, by returning the lifter piston such as to place the cam follower against the cam base circle, the wear of the cam striking the follower has been diminished as is the associated noise.

To improve lifter response in the system it is imperative that the oil supply to the lifter be free of restrictions so that oil can be pulsed and pushed into the lifter quickly and undiminished. It has been further noted that the use of such high pressures on the system due to the pressure pulses generated, suitable oil rings 128 must be positioned about the lifters as illustrated in FIG. 5.

The interior of the lifter 51 must be such that the lifter piston 80 is able to be compressed without binding the return spring 84. Such feature is a matter of design such that the lifter piston does not return so close to the bottom as to bind the coils of the return spring.

While the system has been described as a single function microprocessor based system mainly for controlling of engine valves such a control system may be combined with ignition and fuel injection systems into an overall system. This is easily done inasmuch as both ignition and fuel injection systems require much of the same input signals and have much of the same processing capabilities as the present system.

There has thus been shown and described an engine valve timing control system utilizing a microprocessor based control system and operating such that in a closed loop hydraulic oil system the pressure pulses generated by means of cam actuations operate to generate high pressure pulses on the fluid lines for returning the off lifters to the base line position on the cams. The system illustrates the method of controlling each cylinder individually such that its timing is unique and not dependent upon or a function of the previous or next cylinder's timing nor is it a function of the previous cycle of the same cylinder. Various parameters are functions of design such as the parameter supplying the signal to the absolute timer indicating that a known position of a known cylinder which may be just one cylinder of the whole engine or each particular cylinder in the engine.

What is claimed is:

1. A closed loop electrohydraulic engine valve timing control system for individually controlling the operate times of at least two of the cylinder valves in an internal combustion engine; the system having a camshaft means with at least one cam for each valve, each cam having a cam base circle; a cam follower coupled between each of the cams and the cylinder valves; a hydraulic valve lifter having a zero lash height holding the cam follower against the cam base circle with the cylinder valve closed and a controlled height providing a pivot for the cam follower for opening the cylinder valve; fluid lines connecting the lifters with a source of fluid; the closed loop electrohydraulic system characterized by:

a solenoid control valve connected to each of the lifters, the control valve normally closed preventing the flow of fluid through the lifters;

electronic control unit means for opening each of said solenoid control valves controlling the flow of fluid from the lifters establishing the controlled height of the lifter and for closing the solenoid control valves forming a hydraulic link in the lifters at said controlled height for pivoting the cam follower to open the cylinder valve; and check valves located in each of the fluid lines controlling the flow of fluid in one direction through the lifters, said check valves directing fluid and fluid pressure pulses from one of the lifters having its respective solenoid control valve opened to the other lifters having their respective control valve closed, thereby returning said other lifters to their zero lash height.

2. A closed loop electrohydraulic engine valve timing control system having at least two hydraulic valve lifters cooperating with timing cams and cam followers for opening and closing engine valves; each of the lifters having an input, an output, a zero lash height holding the cam follower against the timing cam base circle with the engine valve closed and a controlled height providing a pivot for the cam follower; a solenoid control valve; the inputs of the lifters connected to a supply line and the outputs connected to the input of the solenoid control valve; the output of the solenoid control valve connected to the supply line forming a closed loop fluid system; the improvement comprising:

check valves controlling fluid flow in one direction through the lifters when the solenoid valve is open for directing the fluid pulse developed by the cam follower pivoting on one of said lifters to the other of said lifters not in pivoting contact with a cam follower for restoring the other of said lifters to its zero lash height.

* * * * *